US009761355B2

(12) United States Patent
Lee et al.

(10) Patent No.: US 9,761,355 B2
(45) Date of Patent: Sep. 12, 2017

(54) RESISTANCE ASSEMBLY FOR MOBILE DEVICE AND MANUFACTURING METHOD THEREOF

(71) Applicant: SAMSUNG ELECTRO-MECHANICS CO., LTD., Suwon-Si, Gyeonggi-Do (KR)

(72) Inventors: Jea-Hoon Lee, Suwon (KR); Woo-Jin Choi, Suwon (KR); Young-Key Kim, Suwon (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 90 days.

(21) Appl. No.: 14/696,246

(22) Filed: Apr. 24, 2015

(65) Prior Publication Data

US 2015/0310970 A1 Oct. 29, 2015

(30) Foreign Application Priority Data

Apr. 25, 2014 (KR) ..... 10-2014-0050079

(51) Int. Cl.

| | |
|---|---|
| ***H01C 1/01*** | (2006.01) |
| ***H01C 1/14*** | (2006.01) |
| ***H01C 7/00*** | (2006.01) |
| ***H01C 13/02*** | (2006.01) |
| ***H01C 17/00*** | (2006.01) |

(52) U.S. Cl.

CPC ..... *H01C 1/01* (2013.01); *H01C 1/14* (2013.01); *H01C 7/003* (2013.01); *H01C 13/02* (2013.01); *H01C 17/006* (2013.01)

(58) Field of Classification Search

CPC ..... H01C 1/01; H01C 17/28; H01C 7/003

USPC ..... 338/309, 313, 325, 327, 332

See application file for complete search history.

(56) References Cited

U.S. PATENT DOCUMENTS

| | | | | |
|---|---|---|---|---|
| 3,876,912 A * | 4/1975 | Sanders | H01C 13/02 | 338/309 |
| 3,996,551 A * | 12/1976 | Croson | H01C 7/006 | 216/16 |
| 5,179,366 A * | 1/1993 | Wagner | H01C 1/084 | 338/308 |
| 6,097,276 A * | 8/2000 | Van Den Broek | H01C 7/06 | 338/22 R |

(Continued)

FOREIGN PATENT DOCUMENTS

KR 10-201400500 A 8/1989

OTHER PUBLICATIONS

Korean Office Action issued in corresponding Korean Patent Application No. 10-2014-0050079 on Jul. 30, 2015 (pp. 1-4 in English; pp. 5-8 in Korean).

*Primary Examiner* — Kyung Lee
(74) *Attorney, Agent, or Firm* — NSIP Law

(57) ABSTRACT

A resistance assembly for a mobile device and a manufacturing method thereof are disclosed. The resistance assembly for a mobile device in accordance with an embodiment of the present invention includes: a substrate having a circuit formed thereon; first to third pads laminated and separated from one another on the substrate; first to third terminals connected to the first to third pads, respectively; and first and second resistors formed between the first and second terminals and between the second and third terminals, respectively, and serially connected to each other and configured to adjust electric current flowed into the circuit.

5 Claims, 3 Drawing Sheets

(56) References Cited

U.S. PATENT DOCUMENTS

| | | | | |
|---|---|---|---|---|
| 6,314,637 | B1 * | 11/2001 | Kimura | H01C 1/142<br>29/610.1 |
| 7,193,499 | B2 * | 3/2007 | Tsukada | H01C 1/144<br>338/309 |
| 8,081,059 | B2 * | 12/2011 | Tanimura | H01C 1/148<br>338/307 |
| 8,098,127 | B2 * | 1/2012 | Tchaplia | H01P 5/16<br>338/254 |
| 2009/0085716 | A1 * | 4/2009 | Kim | H01C 1/14<br>338/325 |

* cited by examiner

RESISTANCE ASSEMBLY FOR MOBILE DEVICE AND MANUFACTURING METHOD THEREOF

CROSS-REFERENCE TO RELATED APPLICATIONS

This application claims the benefit of Korean Patent Application No. 10-2014-0050079, filed with the Korean Intellectual Property Office on Apr. 25, 2014, the disclosure of which is incorporated herein by reference in its entirety.

BACKGROUND

1. Technical Field

The present invention relates to a resistance assembly for a mobile device and a manufacturing method thereof.

2. Background Art

Among various cases of using resistance in a circuit, the circuit is sometimes designed to have its operation assisted by adjusting a current of a power. In this kind of circuit design, if the resistance is damaged and faulted (i.e., shorted) by an external shock (e.g., surge, static electricity, etc.), all of the current of the power may be flowed into the integrated circuit, possibly causing a secondary damage to the circuit.

Contemplated to prevent this kind of phenomenon is designing the circuit with a plurality of resistance or designing the circuit with an array type of resistance. However, this kind of circuit design will inevitably increase the use of space by a substrate.

Particularly, as mobile devices are increasingly smaller and more precise, increasing the substrate space for the stability of circuit as described above would not be very preferable, and thus studies are demanded for a resistance assembly that can adjust the current flowed in the circuit more effectively.

The related art of the present invention is disclosed in Korea Patent Publication No. 10-2013-0070682 (Jun. 28, 2013).

SUMMARY

The present invention provides a resistance assembly for a mobile device and a manufacturing method thereof that can effectively adjust a current flowed into a circuit.

An aspect of the present invention provides a resistance assembly for a mobile device that includes: a substrate having a circuit formed thereon; first to third pads laminated and separated from one another on the substrate; first to third terminals connected to the first to third pads, respectively; and first and second resistors formed between the first and second terminals and between the second and third terminals, respectively, and serially connected to each other and configured to adjust electric current flowed into the circuit.

The first and second resistors can be integrally formed, and the first to third terminals can be formed by covering the integrally formed first and second resistors.

A resistance value of one of the first and second resistors can be successively trimmed according to a resistance value of the other of the first and second resistors that is determined through trimming.

One of the first and second resistors that is designed to have a relatively greater resistance value can be trimmed first.

The first and second resistors can have a protective layer formed on surfaces thereof so as to protect portions of the first and second resistors that are exposed in between the first to third terminals.

Another aspect of the present invention provides a method of manufacturing a resistance assembly for a mobile device that includes: forming integrally-structured first and second resistors; forming first to third terminals separated from one another and covering either end and a middle portion, respectively, of the integrally-structured first and second resistors; and connecting the first to third terminals to first to third pads, respectively, the first to third pads being laminated and separated from one another on a substrate having a circuit formed thereon.

The method of manufacturing a resistance assembly for a mobile device can further include, after the forming of the first to third terminals, forming a protective layer on surfaces of the first and second resistors that are exposed in between the first to third terminals.

According to certain embodiments of the present invention, the first and second resistors can commonly use one terminal among the first to third terminals, and thus the current flowing in the circuit can be controlled more effectively.

DETAILED DESCRIPTION

Figure 1:
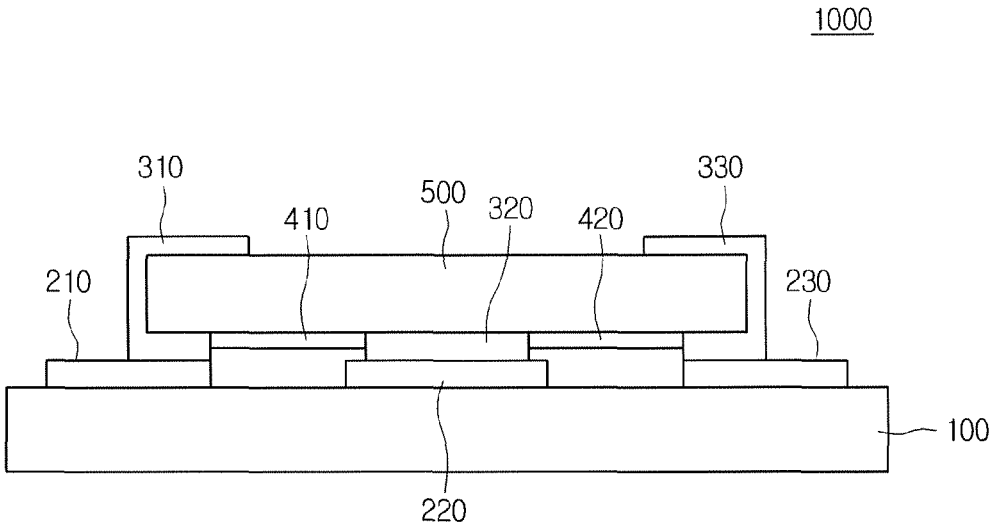
FIG. 1 is a resistance assembly for a mobile device in accordance with an embodiment of the present invention.

Hereinafter, certain embodiments of a resistance assembly for a mobile device and a manufacturing method thereof in accordance with the present invention will be described in detail with reference to the accompanying drawings. In describing the present invention with reference to the accompanying drawings, any identical or corresponding elements will be assigned with same reference numerals, and no redundant description thereof will be provided.

Terms such as "first" and "second" can be used in merely distinguishing one element from other identical or corresponding elements, but the above elements shall not be restricted to the above terms.

When one element is described to be "coupled" to another element, it does not refer to a physical, direct contact between these elements only, but it shall also include the possibility of yet another element being interposed between these elements and each of these elements being in contact with said yet another element.

Figure 2:
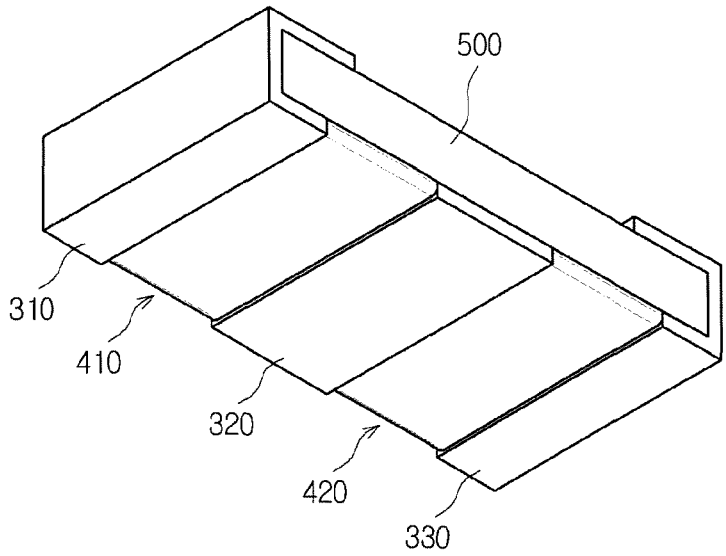
FIG. 2 shows details of terminals and resistors in the resistance assembly for a mobile device in accordance with an embodiment of the present invention.

FIG. 1 is a resistance assembly for a mobile device in accordance with an embodiment of the present invention. FIG. 2 shows details of terminals and resistors in the resistance assembly for a mobile device in accordance with an embodiment of the present invention.

As illustrated in FIG. 1 and FIG. 2, a resistance assembly 1000 for a mobile device in accordance with an embodiment of the present invention includes a substrate 100, a first pad 210, a second pad 220, a third pad 230, a first terminal 310, a second terminal 320, a third terminal 330, a first resistor 410 and a second resistor 420.

The substrate 1000, where a circuit is formed, has an integrated circuit (IC) formed thereon for specific operation or control of a mobile device and can have an electric current supplied thereto from an individual power source.

In such a case, the substrate 100 can include a variety of wired lines or further include different kinds of semiconductor devices, such as a transistor. Moreover, the substrate 100 can be constituted in various ways as necessary by, for example, including a conductive layer or a dielectric layer.

The first to third pads 210, 220, 230 are laminated on the substrate 100 but are separated from one another, and the first to third terminals 310, 320, 330 are connected to the first to third pads 210, 220, 230, respectively, and include a conductive material and thus can electrically connect the first and second resistors 410, 420 to a circuit formed on the substrate 100.

By connecting the first to third terminals 310, 320, 330 to the first to third pads 210, 220, 230, respectively, as shown in FIG. 1, the first to third pads 210, 220, 230 can be electrically connected to the first to third terminals 310, 320, 330, respectively, and then to the circuit formed on the substrate 100, thereby allowing the first and second resistors 410, 420 formed in between the first to third terminals 310, 320, 330 to be connected to the circuit.

The first and second resistors 410, 420 are formed between the first and second terminals 310, 320 and between the second and third terminals 320, 330, respectively, and are serially connected with each other to adjust the current flowed to the circuit. The first and second resistors 410, 420 can commonly use the second terminal 320.

Meanwhile, a resistance body 500, which is made of, for example, an aluminum substrate, can be used in order to support the first to third terminal 310, 320, 330 and the first to third resistors 410, 420, 430.

The circuit formed on the substrate 100 as described above can use a resistor in order to adjust the electric current, and two or more resistors or an array of resistors can be used in order to prevent the circuit from being damaged by a damage to the resistor caused by an external impact (e.g., surge, static electricity, etc.).

In such a case, if two of stand-alone resistors are used, each stand-alone resistor formed by disposing one resistor in between a pair of terminals, more space is used due to the installation of two resistors, making it disadvantageous for realizing a smaller and more precise mobile device.

Moreover, if an array of resistors, in which two pairs of terminals are formed in a parallel form and a resistor is disposed between each pair of terminals, are used, the terminals need to be sufficiently separated in order to prevent a short-circuit between the terminals, also making it disadvantageous for realizing a smaller and more precise mobile device.

Accordingly, since the resistance assembly 1000 for a mobile device in accordance with the present embodiment can allow the first and second resistors 410, 420 to commonly use one terminal 320 among the first to third terminals 310, 320, 330, the current flowing in the circuit can be controlled more effectively.

Specifically, the resistance assembly 1000 can be realized in a three-terminal type, which is constituted with one common terminal 320 for two resistors 410, 420 and two terminals 310, 330 for two resistors 410, 420, respectively. As a result, one fewer terminal can be used substantively, and thus a smaller resistance assembly 1000 can be manufactured with a method that is similar to conventional methods.

Moreover, as the common terminal 320 is used, it becomes possible to solve the separation issue for preventing short-circuit between the terminals when an array of resistors is used.

Moreover, through the second pad 220 and the second terminal 320 formed in a middle portion of the substrate 100, the resistor assembly 1000 for a mobile device in accordance with the present embodiment can improve a warpage strength against an external force exerted to the substrate 100.

Furthermore, through the second pad 220 and the second terminal 320 formed in the middle portion of the substrate 100, heat can be dissipated through the middle portion, as well as end portions, of the substrate 100, thereby improving a heat-dissipating property of the resistance assembly 1000 for a mobile device in accordance with the present embodiment.

In the resistance assembly 1000 for a mobile device in accordance with the present embodiment, the first and second resistors 410, 420 can be integrally formed, and the first to third terminals 310, 320, 330 can be formed by covering the integrally-formed first and second resistors 410, 420.

It may be possible that the first and second resistors 410, 420 are formed, respectively, between the first and the second terminals 310, 320 and between the second and third terminals 320, 330 after the first to third terminals 310, 320, 330 are formed first, but in such a case, portions of the terminals 310, 320, 330 may be covered by the resistors 410, 420, making it difficult to provide effective widths of the terminals 310, 320, 330 for electrical connection with the first to third pads 210, 220, 230.

Providing an effective width may be particularly important for the second terminal 320 because it is disposed in a middle portion of the resistance body 500, unlike the first and third terminals 310, 330, which can also utilize either lateral end surface of the resistance body 500.

Therefore, the resistance assembly 1000 for a mobile device in accordance with the present embodiment can provide the effective widths of the terminals 310, 320, 330 more easily by integrally forming the first and second resistors 410, 420 (refer to FIG. 4) and then forming the first to third terminals 310, 320, 330 so as to cover the first and second resistors 410, 420 (refer to FIG. 50).

In the resistance assembly 1000 for a mobile device in accordance with the present embodiment, a resistance value for one of the first and second resistors 410, 420 can be successively trimmed according to a resistance value of the other of the first and second resistors 410, 420 that is determined through trimming.

Here, trimming, which refers to a process such as cutting for minute adjustment of a resistance value, can be a process for determining resistance values configured for the resistors 410, 420 while designing the circuit.

For instance, if the circuit is designed to set the resistance value of 100 ohms is set for each of the first and second resistors 410, 420 with an error range of −5 to 5%, the first resistor 410 can have a deviation of 95 to 105 ohms.

Here, if the resistance value of the first resistor 410 is determined to be 95 ohms through trimming, the second resistor 420 can be trimmed after the resistance value is offset to 105 ohms.

As a result, the resistance value of the second resistor 420 becomes 99.75 to 110.25 ohms, and the overall resistance value of the first and second resistors 410, 420 can become 194.75 to 205.25 ohms.

Therefore, the deviation of the overall resistance value of the first and second resistors 410, 420 becomes approximately −2.5 to 2.5%, making it possible to reduce the error of the resistance value than using two stand-alone resistors or an array of resistors.

Accordingly, the resistance assembly 1000 for a mobile device in accordance with the present embodiment can be realized to be precise by reducing the overall resistance value of the resistors 410, 420, by successively trimming the resistance value of one of the first and second resistors 410, 420 according to the resistance value of the other of the first and second resistors 410, 420 determined through trimming.

Here, one of the first and second resistors 410, 420 that is designed to have a relatively greater resistance value can be trimmed first.

In other words, between the first and second resistors 410, 420, the resistor (e.g., 410) designed to have a greater resistance value can be trimmed first and have its actual resistance value determined, and then the resistor (e.g., 420) designed to have a smaller resistance value can be trimmed.

As a result, the error range of the overall resistance value of the first and second resistors 410, 420 is determined by the error range of the resistor (e.g., 420) that is designed to have the smaller resistance value, and thus the error range of the overall resistance value can be further reduced.

Therefore, the resistance assembly 1000 for a mobile device in accordance with the present embodiment can be realized to be more precise by first trimming one of the first and second resistors 410, 420 that is designed to have a relatively greater resistance value.

In the resistor assembly 1000 for a mobile device in accordance with the present embodiment, a protective layer 430 can be formed on surfaces of the first and the second resistors 410, 420 so as to protect portions of the first and second resistors 410, 420 that are exposed in between the first to third terminals 310, 320, 330.

In such a case, the protective layer 430 is a kind of a film that is coated on surfaces of the first and second resistors 410, 420 so as to protect the exposed portions of the first and second resistors 410, 420 from oxidation and can be variably constituted, as necessary, by including an anti-corrosive material.

Accordingly, the resistance assembly 1000 for a mobile device in accordance with the present embodiment can minimize a damage to the first and second resistors 410, 420 to realize an improved durability and optimal performance of the resistance assembly 1000 for a mobile device.

Figure 3:
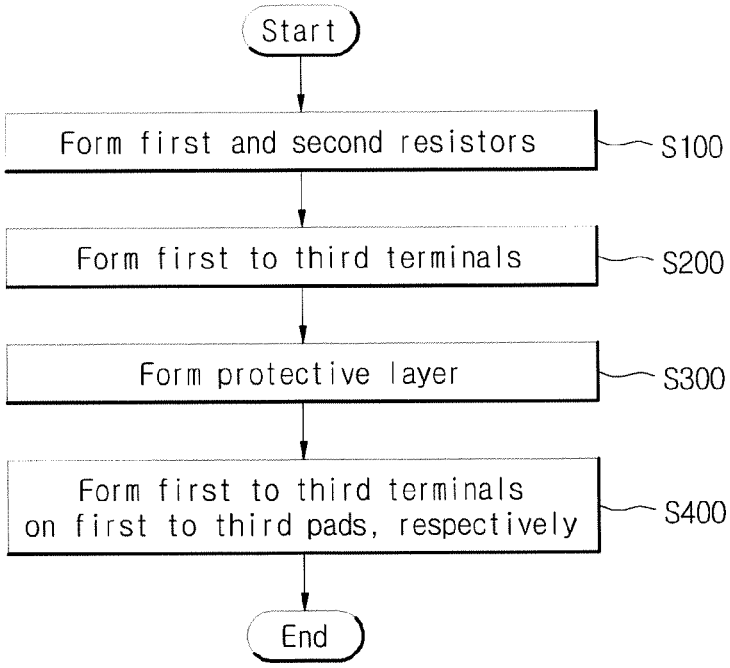
FIG. 3 is a flow diagram showing a method of manufacturing a resistance assembly for a mobile device in accordance with an embodiment of the present invention.

FIG. 3 is a flow diagram showing a method of manufacturing a resistance assembly for a mobile device in accordance with an embodiment of the present invention. FIG. 4, FIG. 5, FIG. 6 and FIG. 7 are cross-sectional views showing each respective step of the method of manufacturing a resistance assembly for a mobile device in accordance with an embodiment of the present invention.

Here, for the convenience of description, elements used to describe the method of manufacturing a resistance assembly for a mobile device in accordance with an embodiment of the present invention will be described with reference to FIG. 1 and FIG. 2.

Figure 4:
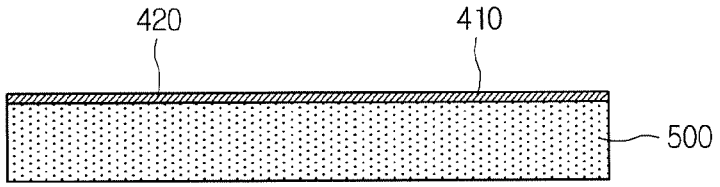
FIG. 4, FIG. 5, FIG. 6 and FIG. 7 are cross-sectional views showing each respective step of the method of manufacturing a resistance assembly for a mobile device in accordance with an embodiment of the present invention.

As illustrated in FIG. 3 to FIG. 7, the method of manufacturing a resistance assembly for a mobile device in accordance with an embodiment of the present invention can start with forming a first resistor 410 and a second resistor 420 that are integrally formed (S100, FIG. 4). Here, the first and second resistors 410, 420 can be formed on one surface of a resistance body 500.

Figure 5:
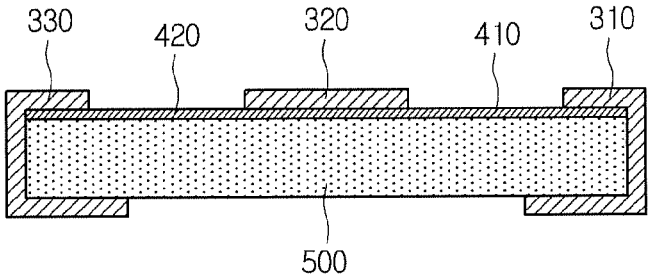

Formed thereafter can be a first terminal 310, a second terminal 320 and a third terminal 330 that cover either end and a middle portion, respectively, of the first and second resistors 410, 420 and are separated from one another (S200, FIG. 5).

That is, the first terminal 310 and the third terminal 330 can be formed at either end of the resistance body 500, respectively, on which the first resistor 410 and the second resistor 420 are formed, and the second terminal 320 can be formed in a middle portion of the resistance body 500.

In such a case, by integrally forming the first and second resistor 410, 420 and then forming the first to third terminals 310, 320, 330 so as to cover the first and second resistors 410, 420, it becomes possible to provide an effective width for each of the terminals 310, 320, 330.

Figure 7:
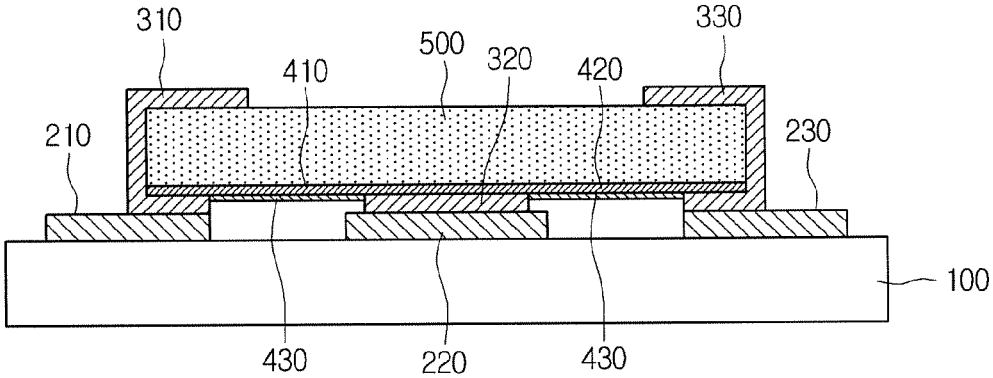

Afterwards, the first to third terminals 310, 320, 330 can be connected to a first pad 210, a second pad 220, a third pad 230, respectively, which are laminated and separated from one another on a substrate 100 having a circuit formed thereon (S400, FIG. 7).

Through this, the first to third pads 210, 220, 230 are electrically connected to the first to third terminals 310, 320, 330 and then to the circuit formed on the substrate, and thus the first and second resistors 410, 420 formed in between the first to third terminal 310, 320, 330 can be connected to the circuit.

As such, in the method of manufacturing a resistance assembly for a mobile device in accordance with the present embodiment, since the serially connected first and second resistors 410, 420 can use one terminal 320 of the first to third terminals 310, 320, 330 as a common terminal, the electric current flowed to the circuit can be adjusted more effectively.

Figure 6:
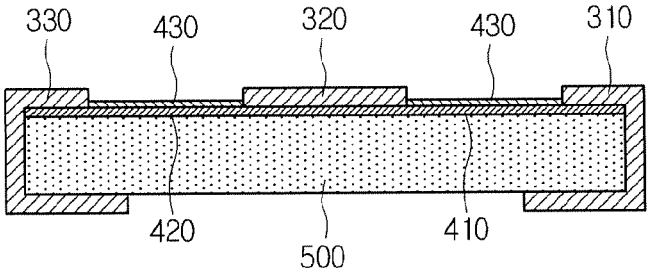

The method of manufacturing a resistance assembly for a mobile device in accordance with the present embodiment can further include, after step S200, forming a protective layer 430 on surfaces of the first and the second resistors 410, 420 that are exposed in between the first to third terminals 310, 320, 330 (S300, FIG. 6).

That is, the protective layer 430 can be formed on the surfaces of the first and the second resistors 410, 420 so as to prevent the first and second resistors 410, 420 from oxidation.

Accordingly, the method of manufacturing a resistance assembly for a mobile device in accordance with the present embodiment can minimize a damage to the first and second resistors 410, 420 to realize an improved durability and optimal performance of the resistance assembly for a mobile device.

The elements associated with the method of manufacturing a resistance assembly for a mobile device in accordance with an embodiment of the present invention have been already described with reference to the resistance assembly 1000 for a mobile device and thus will not be described redundantly.

Although certain embodiments of the present invention have been described hitherto, it shall be appreciated that the present invention can be variously modified and permutated by those of ordinary skill in the art to which the present invention pertains by supplementing, modifying, deleting and/or adding an element without departing from the technical ideas of the present invention, which shall be defined by the claims appended below. It shall be also appreciated that such modification and/or permutation are also included in the claimed scope of the present invention.

What is claimed is:

1. A resistance assembly comprising:

a body portion having a first surface and a second surface opposing each other;

a first resistor and a second resistor disposed on the first surface of the body portion and formed integrally with each other;

a first terminal and a third terminal disposed on surfaces of the first resistor and the second resistor, respectively, and separated from each other; and a second terminal spaced apart from each of the first and third terminals, and connected to the surfaces of the first and second resistors in common, wherein the first resistor and the second resistor are formed of a same material, wherein the first terminal and the third terminal are in direct contact with the first resistor and the second resistor, respectively, wherein the second terming is in direct contact with the resistor and the second resistor in common, and where the first resistor and the second resistor are forming in a single layer.

2. The resistance assembly of claim 1, further comprising a protective layer configured to protect the first resistor between the first and second terminals, and protect the second resistor between the second and third terminals.

3. The resistance assembly of claim 1, wherein the first and third terminals extend from respective surfaces of the first and second resistors to sides of the body portion.

4. A method of manufacturing a resistance assembly, the method comprising:

forming a first resistor and a second resistor integrally with each other on a first surface of a body portion comprising the first surface and a second surface opposing each other;

forming a first terminal and a third terminal on surfaces of the first and second resistors, respectively, and separated from each other; and forming a second terminal spaced apart from each of the first and third terminals and connected to the surfaces of the first and second resistors in common, wherein the first resistor and the second resistor are formed of a same material, wherein the first terminal and the third terminal are in direct contact with the first resistor and the second resistor, respectively, wherein the second terminal is in direct contact with the first resistor and the second resistor in common, and wherein the first resistor and the second resistor are formed in a single layer.

5. The method of claim 4, further comprising, forming a protective layer protecting the first resistor, provided between the first and second terminals, and protecting the second resistor, provided between the second and third terminals.

* * * * *